United States Patent [19]

Waldinger et al.

[11] Patent Number: 5,022,773

[45] Date of Patent: Jun. 11, 1991

[54] RETRACTABLE PEN WITH SELF SEALING WRITING TIP OPENING

[76] Inventors: Richard Waldinger, 11 Ridge Rd., Searingtown, N.Y. 11507; Allan L. Backus, 1550 Centinela Ave., #210, Los Angeles, Calif. 90025

[21] Appl. No.: 502,252

[22] Filed: Mar. 30, 1990

[51] Int. Cl.[5] ..... B43K 34/00; B43K 3/02; B43K 5/16

[52] U.S. Cl. ..... 401/107; 401/59

[58] Field of Search ..... 401/59, 104, 213, 60, 401/248, 107

[56] References Cited

U.S. PATENT DOCUMENTS

| | | | |
|---|---|---|---|
| 2,291,859 | 8/1942 | Andrews | 401/107 |
| 3,583,820 | 6/1971 | Koein | 401/107 |
| 3,637,316 | 1/1972 | Bross | 401/107 |
| 4,540,300 | 9/1985 | Midorikawa | 401/107 |
| 4,618,280 | 10/1986 | Kageyama | 401/107 |

FOREIGN PATENT DOCUMENTS

| | | | |
|---|---|---|---|
| 1424491 | 12/1965 | France | 401/107 |
| 581030 | 10/1976 | Switzerland | 401/107 |
| 697084 | 9/1953 | United Kingdom | 401/107 |

*Primary Examiner*—Richard J. Johnson

*Attorney, Agent, or Firm*—Baker, Maxham, Jester & Meador

[57] ABSTRACT

A writing instrument having a retractable writing tip and hollow pliable seal with a closure pinched by a metal spring clip to seal the instrument's writing tip from contact with open air. The instrument may use writing tips, such as roller ball, fountain and felt tips, which employ volatile inks.

5 Claims, 3 Drawing Sheets

RETRACTABLE PEN WITH SELF SEALING WRITING TIP OPENING

BACKGROUND

1. Field of Invention

The present invention relates to retractable pens. More particularly, the present invention relates to retractable pens having felt tip, roller ball, fountain and other writing tips employing volatile writing fluids. Still more particularly, the present invention relates to retractable pens having self-sealing writing tip openings.

2. Description of Prior Art

Felt tip, roller ball, fountain and other writing tips using volatile inks offer many desirable writing features not found in conventional ball point pens. Pens using these writing tips, however, lack the convenience of easy writing tip retraction. Instead, pens using volatile inks generally must have a cap placed over their writing tips after each use. Failure to recap such pens whether through oversight or loss of the cap, usually results in permanent pen damage, i.e., their ink reservoirs dry out or solid components of their writing fluids dry out and become deposited in the writing tips impairing proper pen function.

Such pens must also be recapped in order to prevent soilage of clothing while such pens are being carried. Unlike ball point pens which use viscous inks, pens using volatile inks generally use low viscosity inks which can produce large clothing stains from capillary action.

Even ball pens using viscous inks tend to dry out over time. Thus there is an evident need for a retractable pen which provides a means for preventing pen damage due to ink drying, particularly in pens using volatile inks, but also in ball pens.

OBJECTS AND ADVANTAGES

In view of the foregoing drawbacks and deficiencies of the prior art, it is an object of the present invention to allow felt tip, roller ball, fountain and other pens using volatile inks to use convenient writing tip retraction mechanisms.

It is another object of the present invention to help prevent soilage of clothing from writing tip contact.

Readers will find further objects and advantages of the present invention from a consideration of the ensuing description and the accompanying drawings.

SUMMARY OF THE INVENTION

The present invention provides means to allow felt tip, roller ball, fountain and other pens using volatile inks to use convenient writing tip retraction mechanisms. To that end, sealing means are provided to close the barrel's writing tip aperture each time the writing tip is retracted. This closure helps prevent ink evaporation when the pen is not in use and means may also be provided to help stop soilage of clothing when the pen is being carried.

DETAILED DESCRIPTION

Figure 1:
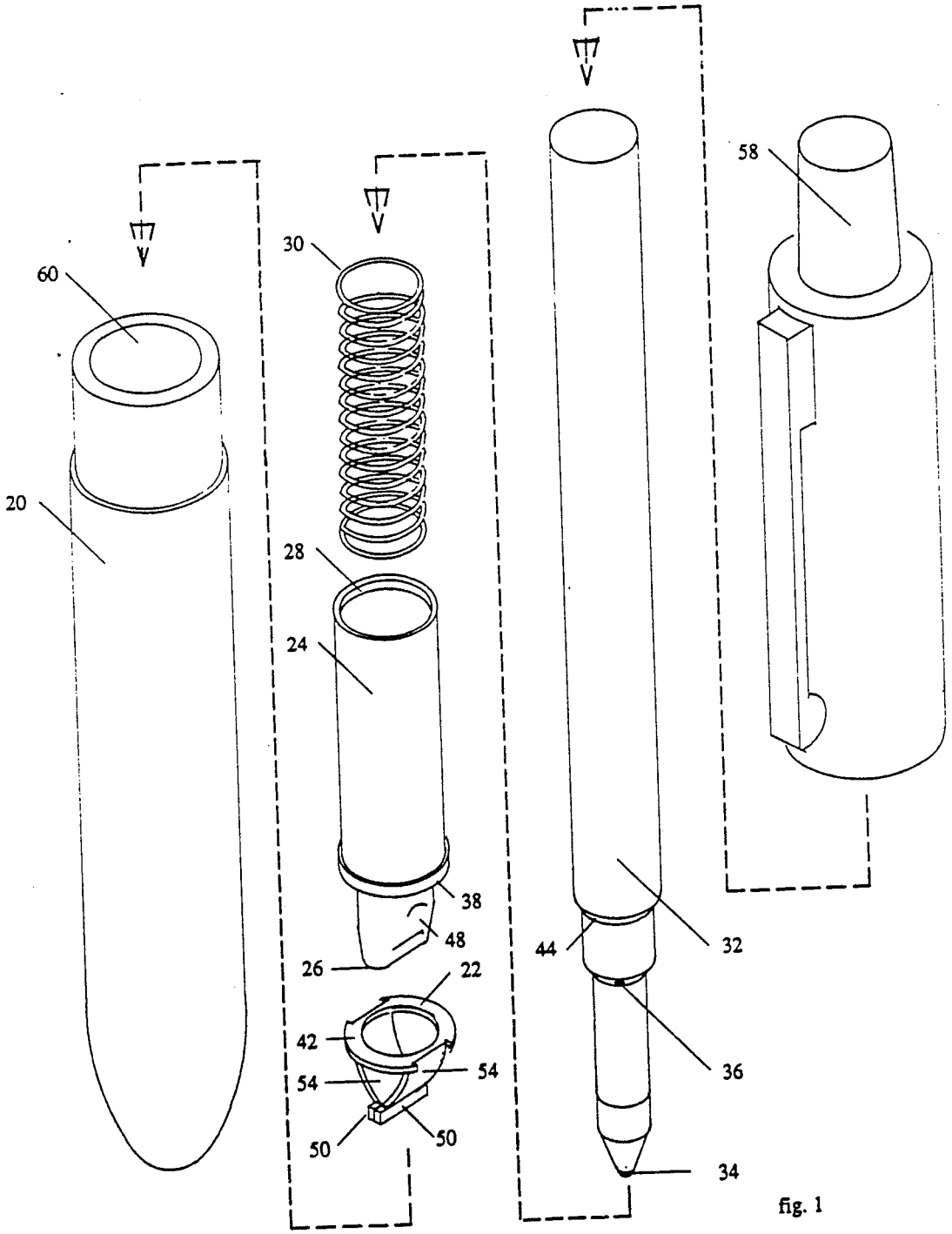
FIG. 1 is an exploded view of the lower portion of a pen constructed in accordance with the present invention.

Referring to FIGS. 1 through 6, a lower portion of a pen is shown with an outer barrel 20, a spring clip 22, a pliable seal 24 with writing tip closure 26 and writing fluid reservoir seal 28, a return spring 30, and a writing fluid reservoir 32 having a writing tip 34 and reservoir air vent 36.

To prevent damage to the writing tip 34 and writing fluid reservoir 32 caused by evaporation of writing fluid components, the writing tip 34 and writing fluid reservoir vent 36, if present, must be sealed from contact with open air when the pen is not in use.

To accomplish this, the pen has a unitary pliable seal 24 with a spring biased linear closure 26 at one end, and a secondary annular seal 28 which contacts the essentially cylindrical writing fluid reservoir at the opposite end. FIGS. 1 through 6 indicate the overall cylindrical shape of the pliable seal 24 between the spring biased closure 26 and the secondary seal 28. Returning to FIG. 2, an annular shoulder 38 at the base of the pliable seal 24 opposes an annular shoulder 40 in the lower portion of the pen barrel 20. A pierced planar section 42 of the spring clip 22 intervenes intermediate to the shoulders 38 and 40 thus stabilizing the position of the spring clip 22. The helical wire return spring 30, resting on the inside portion of the pliable seal shoulder 38 and on an annular shoulder 44 located on the lower portion of the writing fluid reservoir 32, biases opposition between the pliable seal shoulder 38 and the writing fluid reservoir 32 thus helping stabilize the pliable seal 24.

When the pen is not in use and the writing tip 34 is retracted, both the writing fluid reservoir's writing tip 34 and air vent 36 are contained within the pliable seal 24 and are shielded from contact with open air by the writing fluid reservoir seal 28 sealing the opposite end of the pliable seal 24 through contact with the writing fluid reservoir 32.

The pliable seal 24 may be made from any of several materials, including but not limited to: silicone rubber, low density polyethylene, polypropylene, etc. Such materials are relatively pliable, can have low friction/-low drag surfaces, and are nonpermeable enough to prevent writing fluid evaporation over long durations. This nonpermeability is important to give the pen the shelf life necessary for merchandising.

Use of a unitary pliable seal 24 which does not rely on any portion of the pen barrel 20 to prevent writing fluid evaporation permits the pen barrel 20 to be constructed from virtually any material including, but not limited to, both metals and plastics. This is a significant advantage to the advertising specialties industry which imprints large numbers of pens with company names and promotional messages. Generally roller ball and felt tip pens must have their barrels constructed from polypropylene to prevent long term writing fluid evaporation. Polypropylene is both difficult to print on and generally will not durably retain printed images against abuse. The embodiment shown may have its barrel constructed from many materials, including but not limited to: brass, steel, and buterate, ABS, and styrene plastics, all of which are easy to print on and durably retain printed images. The barrel may have imprinting on the exterior thereof.

The writing tip closure 26 resembles a tube which has been pinched closed. Thus the writing tip closure includes a generally cylindrical base 46 of reduced diameter in comparison to the generally cylindrical body of the pliable seal 24. The cylindrical base 46 transitions to converging planar walls 48, which transition to an elongated terminus 56, which is pinched closed by the spring clip 22 to form a linear seal 52 when the writing tip 34 is retracted. The clip 22 may be fabricated from many different springy materials including, but not limited to, the spring steel indicated. Spring steel has an advantage of not taking a set, and thus reducing its bias, in the presence of heat or long term deformation. The spring clip 22 fits over the base 46 of the closure 26 and places closing pressure on the writing tip closure 26 to form the linear seal 52. The spring clip 22 includes a pair of arms 54 extending inwardly from the pierced planar section 42 to a pair of pincher elements 50 which abut the terminus of the closure 26.

Figure 2:
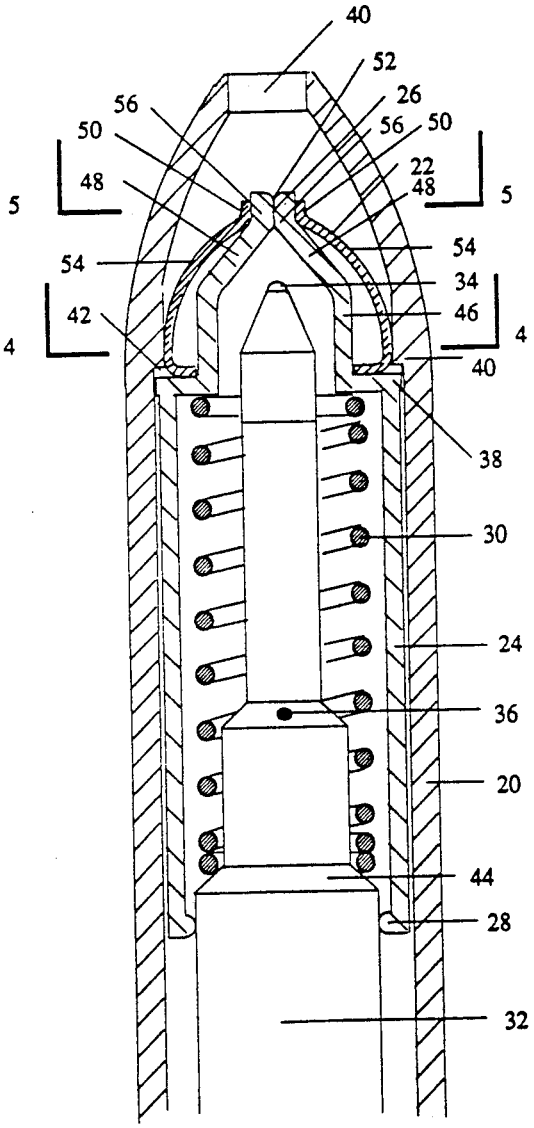
FIG. 2 shows a section through the end of the pen barrel of the pen shown in FIG. 1, showing the writing tip in its retracted position.
Figure 3:
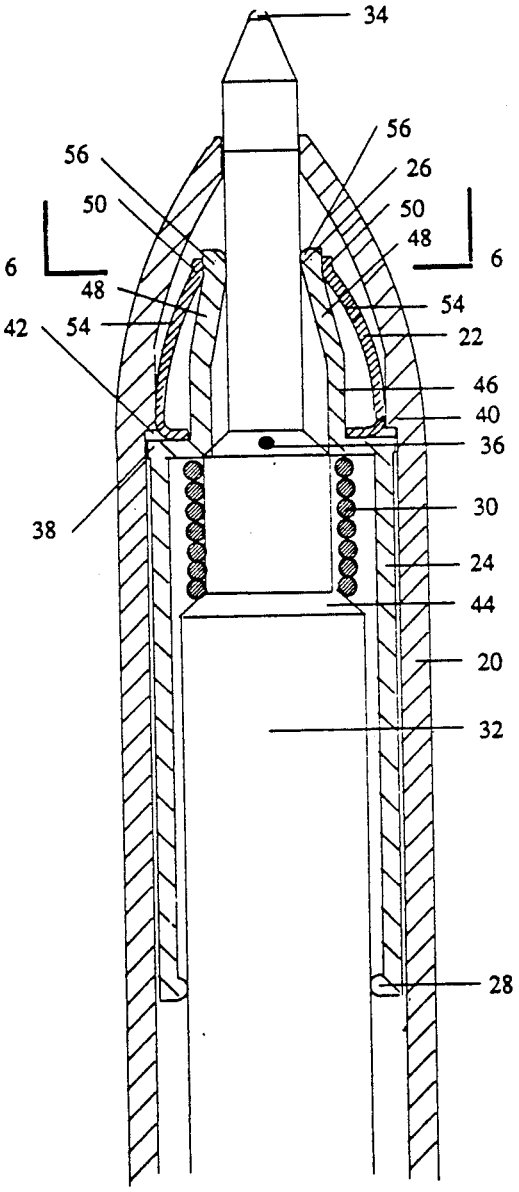
FIG. 3 shows a section through the end of the pen barrel of the pen shown in FIG. 2, showing the writing tip in its protracted position.
Figure 4:
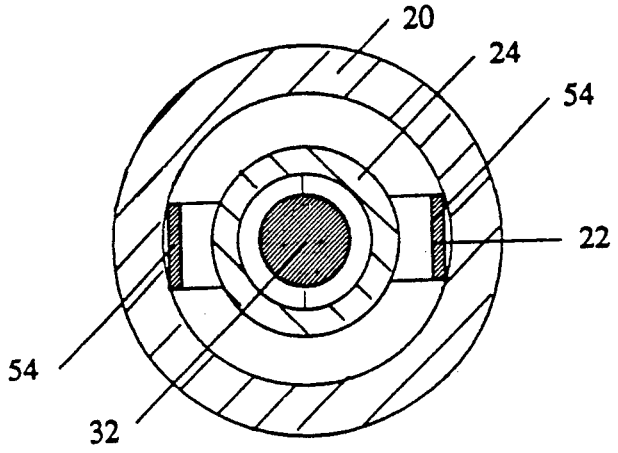
FIG. 4 shows a section through line 4—4 in FIG. 2 showing the writing tip reservoir extending through the upper portion of the writing tip enclosure.
Figure 5:
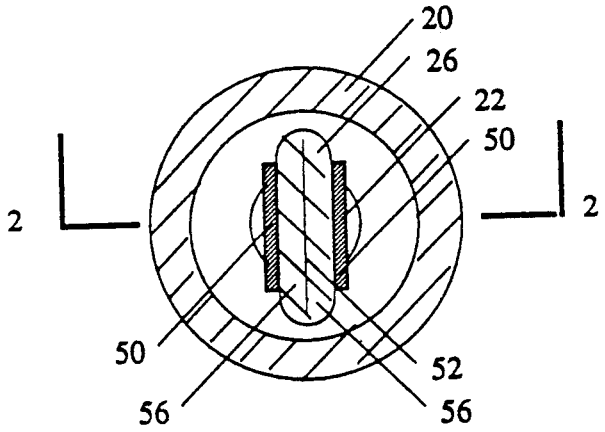
FIG. 5 shows a second section through line 4—4 in FIG. 2 showing the writing tip closure in its closed position.
Figure 6:
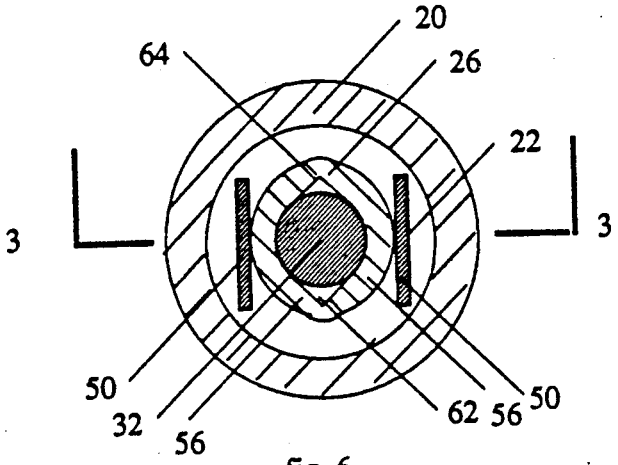
FIG. 6 shows a second section though line 6—6 in FIG. 3 showing the writing tip closure with the pen tip protracted through it.

The helical return spring 30 located inside the pliable seal 24 biases the writing fluid reservoir 32 and writing tip 34 to their retracted positions as shown in FIGS. 2 and 5. This return spring 30 functions in conjunction with any of many retraction mechanisms 58 known to those knowledgeable in the art. Such mechanisms include, but are not limited to: common plunger ratchet mechanisms, twist cam mechanisms, and latching push button mechanisms which latch into their protracted position and are retracted by pressure on a button connected to their latch etc.

The embodiment shown is assembled by inserting the spring clip 22 over the end of the pliable seal 24, placing the return spring 30 with the writing fluid reservoir 32 inserted through it into the opposite end of the pliable seal 24, and then placing the entire assembly into the upper barrel opening 60 and capping the barrel with the protracting/retracting cap mechanism 58.

In operation, the writing tip 34 in its retracted position (FIGS. 2 and 5), biased by the return spring 30, rests entirely within the pliable seal 24 along with the writing fluid reservoir vent 36. When the protraction/-retraction mechanism 58 actuates the writing tip to its protracted position (FIGS. 3 and 6), the writing tip 34 wedges open the writing tip closure 26 which is biased closed by the spring clip 22. This allows the writing tip to protrude through the writing tip orifice 40 in the writing end of the pen barrel 20. Openings 62, 64 formed by the writing tip closure 26 proximate to where the writing fluid reservoir 32 passes through the writing tip closure 26, provide open air venting to the writing fluid reservoir vent 36 when the writing tip 34 is protracted.

The embodiment shown accomplishes the stated goal of having a retractable tip writing instrument which may use roller ball, felt tip, fountain or other writing tips employing volatile writing fluids.

What have been described are certain aspects of a self sealing writing instrument. It is understood that the foregoing description and accompanying illustrations are merely exemplary and are in no way intended to limit the scope of the invention, which is defined solely by the appended claims and their equivalents. Various changes and modifications to the preferred embodiments will be apparent to those skilled in the art. Such changes and modifications may include, but are not limited to: the writing tip closure 26 being pinched closed in a star shape having three or more tips instead of being pinched closed in the simple linear shape shown; the secondary writing fluid reservoir seal 28 being formed from a second piece possibly incorporating part of the barrel 20 to help it make the upper seal; the writing fluid reservoir seal 28 having multiple sealing surfaces instead of the single annular seal indicated; no spring clip 22 being used to bias the pliable seal closed or a spring clip constructed from a material other than spring steel; no return spring 30 being present and instead a retraction mechanism such as that used by Cross (tm) pens being used; the pen barrel 20 being assembled in two or more pieces such as having a removable tip; the parts indicated being constructed at a different scale or in different proportions or using different materials; the pliable seal 24 being disposed higher or lower in the barrel 20; etc.

Such changes and modifications can be made without departing from the spirit and scope of the invention. Accordingly it is intended that all such changes and modifications be covered by the appended claims and equivalents.

We claim:

1. A retractable tip writing instrument with self sealing tip comprising:

a hollow elongated outer housing with a writing tip orifice at one end;

an elongated writing fluid reservoir with a writing tip at one end, said elongated writing fluid reservoir having an air vent and being disposed within said elongated outer housing;

means to protract and retract said writing tip through said writing tip orifice;

a pliable seal disposed entirely within said hollow elongated outer housing, said pliable seal being closed at one end and sealing both said writing tip and said air vent from contact with outside air when said writing tip is retracted, said pliable seal being wedged open by said writing tip when said writing tip is protracted; and wherein said pliable seal has a secondary seal which is in contact with said writing fluid reservoir and both said pliable seal closure and said secondary seal block said writing tip and said vent from contact with outside air.

2. A retractable tip writing instrument with self sealing tip comprising:

a hollow elongated outer housing with a writing tip orifice at one end;

an elongated writing fluid reservoir with a writing tip at one end, said elongated writing fluid reservoir having an air vent and being disposed within said elongated outer housing;

means to protract and retract said writing tip through said writing tip orifice;

a pliable seal disposed entirely within said hollow elongated outer housing, said pliable seal being closed at one end and sealing both said writing tip and said air vent from contact with outside air when said writing tip is retracted, said pliable seal being wedged open by said writing tip when said writing tip is protracted;

wherein said pliable seal has a secondary seal which is in contact with said writing fluid reservoir and both said pliable seal closure and said secondary seal block said writing tip and said vent from contact with outside air; and wherein said writing fluid reservoir is biased to its retracted position by a return spring which is disposed within said hollow pliable seal.

3. A retractable tip writing instrument with self sealing tip comprising:

a hollow elongated outer housing with a writing tip orifice at one end;

an elongated writing fluid reservoir with a writing tip at one end, said elongated writing fluid reservoir having an air vent and being disposed within said elongated outer housing;

means to protract and retract said writing tip through said writing tip orifice;

a pliable seal disposed entirely within said hollow elongated outer housing, said pliable seal being closed at one end and sealing both said writing tip and said air vent from contact with outside air when said writing tip is retracted, said pliable seal being wedged open by said writing tip when said writing tip is protracted;

wherein said pliable seal has a secondary seal which is in contact with said writing fluid reservoir and both said pliable seal closure and said secondary seal block said writing tip and said vent from contact with outside air; and wherein said closed seal and said secondary seal are unitary.

4. A retractable tip writing instrument with self sealing tip comprising:

a hollow elongated outer housing with a writing tip orifice at one end;

an elongated writing fluid reservoir with a writing tip at one end, said elongated writing fluid reservoir having an air vent and being disposed within said elongated outer housing;

means to protract and retract said writing tip through said writing tip orifice;

a pliable seal disposed entirely within said hollow elongated outer housing, said pliable seal being closed at one end and sealing both said writing tip and said air vent from contact with outside air when said writing tip is retracted, said pliable seal being wedged open by said writing tip when said writing tip is protracted;

wherein said pliable seal has a secondary seal which is in contact with said writing fluid reservoir and both said pliable seal closure and said secondary seal block said writing tip and said vent from contact with outside air; and wherein said pliable seal when wedged open has one or more openings at the point where it is wedged open to allow outside air contact with said vent.

5. A retractable writing instrument using volatile writing fluid comprising:

an elongated hollow housing with an orifice at one end;

an elongated writing fluid reservoir disposed within said elongated hollow housing holding volatile writing fluid, said writing fluid reservoir having a writing tip at one end, said writing fluid reservoir also having an air vent;

means to protract and retract said writing tip through said orifice;

means to seal said air vent and writing tip from contact with open air when said writing tip is retracted, said means to seal being disposed within said hollow housing; and a second seal contacting said writing fluid reservoir.

* * * * *